US006478234B1

(12) United States Patent
Klein et al.

(10) Patent No.: US 6,478,234 B1
(45) Date of Patent: Nov. 12, 2002

(54) ADJUSTABLE INJECTOR ASSEMBLY FOR MELTED POWDER COATING DEPOSITION

(75) Inventors: John F. Klein, Port Washington, NY (US); Hans M. Siewertsen, South Farmingdale, NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/883,907

(22) Filed: Jun. 18, 2001

(51) Int. Cl.[7] ..... B05B 1/24
(52) U.S. Cl. ..... 239/80; 239/85; 239/132.3
(58) Field of Search ..... 239/79, 80, 85, 239/128, 132.1, 132.3

(56) References Cited

U.S. PATENT DOCUMENTS

| | | | |
|---|---|---|---|
| 2,862,099 | A | 11/1958 | Gage |
| 3,171,599 | A | 3/1965 | Rotolico |
| 3,935,418 | A | 1/1976 | Stand et al. |
| 4,235,943 | A | 11/1980 | McComas et al. |
| 4,779,802 | A | 10/1988 | Coombs |
| 5,014,916 | A | 5/1991 | Trapani |
| 5,082,179 | A | 1/1992 | Simm |
| 5,234,156 | A | 8/1993 | Ribnitz |
| 5,285,967 | A | 2/1994 | Weidman |
| 5,298,714 | A | 3/1994 | Szente |
| 5,518,178 | A | 5/1996 | Sahoo et al. |
| 5,519,183 | A | 5/1996 | Mueller |
| 5,620,138 | A | 4/1997 | Crum |
| 5,795,626 | A | 8/1998 | Gabel et al. |
| 5,869,146 | A | 2/1999 | McCluskey et al. |

*Primary Examiner*—Lisa A. Douglas
(74) *Attorney, Agent, or Firm*—Stetina Brunda Garred & Brucker

(57) ABSTRACT

A powder injector assembly for delivering powder into an axial flow of heated gas of a powder coating applicator. The assembly includes a powder injector rotatable in a plane whose centerline is perpendicular to the gas flow for issuing powder thereto. An injection nozzle exit port is integral with and leads from the injector and is disposed in the centerline for angular rotation thereabout, and is alignable into the gas flow for powder melting and subsequent substrate deposition. An integral cooling system maintains the powder in a non-melted state until its exit. The injector is independently movable laterally, axially, and angularly for respective radial, axial, and angular movement of the injection nozzle exit port. Angular movement occurs along a centerline passing through the tip of the nozzle exit port to thereby permit independent angle adjustment without changing axial or lateral locations of the injection point.

9 Claims, 2 Drawing Sheets

ADJUSTABLE INJECTOR ASSEMBLY FOR MELTED POWDER COATING DEPOSITION

STATEMENT RE: FEDERALLY SPONSORED RESEARCH/DEVELOPMENT

Statement of Government Rights

This invention was made with Government Support under contract N00014-98-3-0014 awarded by the United States Navy. The Government has certain rights in this invention.

CROSS REFERENCE TO RELATED APPLICATIONS (Not Applicable)

BACKGROUND OF THE INVENTION

This invention relates in general to thermal spray powder-melt coating applicators, and in particular to an adjustable injector assembly whereby powder introduction to a thermal gas spray for ultimate melting and subsequent substrate deposition is provided by a cooled injector whose injection angle is adjustable with respect to the axial centerline of a thermal gas spray nozzle of the assembly without changing axial or radial locations of the injection point.

Present-day application of a coating to a substrate can be accomplished by introducing the coating in precursor-powder form to a high-velocity flow of hot gas such as that found in plasma coating processes for ultimate powder melting and deposition on the substrate to be coated. A typical coating powder applicator provides a nozzle-directed high velocity flow of the heated gas, while injection nozzles of powder injectors are positioned downstream from the nozzle to introduce powder into the hot gas stream. Because of the meltability of the powder situated within the injectors prior to dispensing, present powder injectors must be located outside of the heat zone of the hot gas flow since, otherwise, the powder would melt within the injectors and would no longer be dispersable for introduction into the gas flow. Beyond not having cooling capabilities, present powder injectors typically are limited to a series of fixed locations with respect to angles and distances as measured from the path of gas flow.

As is apparent from the above description of present thermal spray powder coating applicators, current equipment offers little flexibility and limited versatility in applying a substrate coating derived from a powder precursor. In particular, a first such restriction is found in the absence of injector cooling and its resulting relatively-far placement requirements of the injector from the gas flow which is especially critical where the powder has a relatively low melting temperature. This distance interferes with a more efficient and less materials-loss insertion point closer to the hot gas flow. A second such present restriction is found in the inability to precisely direct a powder injection with respect to its angle and distance within the gas flow for achieving a more controlled coating process.

In view of these limitations as found in the prior art, it is apparent that a need is present for a thermal spray powder coating applicator with a powder injector assembly that provides operational adaptability with respect to precursor-powder introduction into a gas flow designated to carry the subsequently-melted powder to a coatable surface. Accordingly, a primary object of the present invention is to provide a powder injector assembly that permits systematic independent adjustment of powder injection angle along with axial and radial locations using a cooled powder injector which will withstand the high temperature environment and also prevent melting of powder prior to its exit from the injector.

Another object of the present invention is to provide a powder injector assembly wherein the injector element has an injection nozzle in communication with an injection nozzle positioner of the assembly for respective radial, axial, and angular movement of the injection nozzle in relation to the flow of heated gas.

Yet another object of the present invention is to provide a powder injection assembly wherein the injection nozzle positioner is operable independently and incrementally radially, axially, and angularly.

These and other objects of the invention will become apparent throughout the description thereof which now follows.

SUMMARY OF THE INVENTION

The present invention is a powder injector assembly for delivering heat-meltable powder into an axial flow of heated gas emanating under pressure from a gas nozzle exit port of a powder coating applicator. The injector assembly comprises a powder injector rotatable in a plane whose centerline is perpendicular to the flow of heated gas from the gas nozzle exit and which is positionable downstream from the gas nozzle exit port for issuing powder into the flow of heated gas. An injection nozzle exit port is integral with and leads from the injector and is disposed in the centerline for angular rotation thereabout, and is alignable with the gas nozzle exit port for issuing powder into the flow of heated gas for melting and subsequent substrate deposition. A cooling system is integral with the injector for removing heat from the injector to thereby maintain the powder within the injector in a non-melted state until its exit into the gas flow. The injector is independently movable laterally, axially, and angularly for respective radial, axial, and angular movement of the injection nozzle exit port in relation to the flow of heated gas. Angular movement of the injector occurs along a centerline passing through the tip of the nozzle exit port to thereby permit independent injection-angle adjustment without changing the axial or lateral location of the injection point.

Because the injector is incrementally and independently movable while the cooling component overcomes location restrictions due to excess heat, an operator can direct powder injection in a most favorable manner with respect to hot gas flow such that a chosen angular injection of powder within a chosen distance radially from the gas flow centerline and axially from the gas nozzle exit port can produce an optimum melted-powder coating result on the substrate. Consequently, powder coatings designed for specific purposes such as such as those charged with wear, corrosion, erosion, and fouling resistance, can be effectively applied to aircraft surfaces, storage tank walls, sensitive electronic instrumentation, and the like where so indicated with broad powder injection flexibilities in accord with particular coating needs and attributes.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
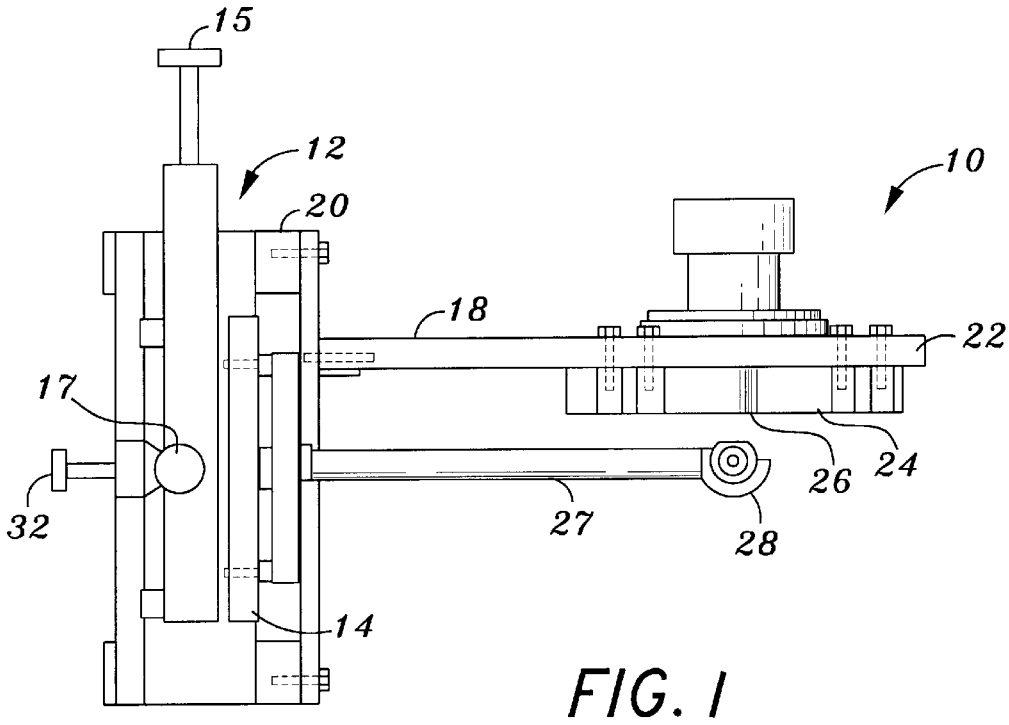
FIG. 1 is a top plan view of a powder injector assembly.
Figure 2:
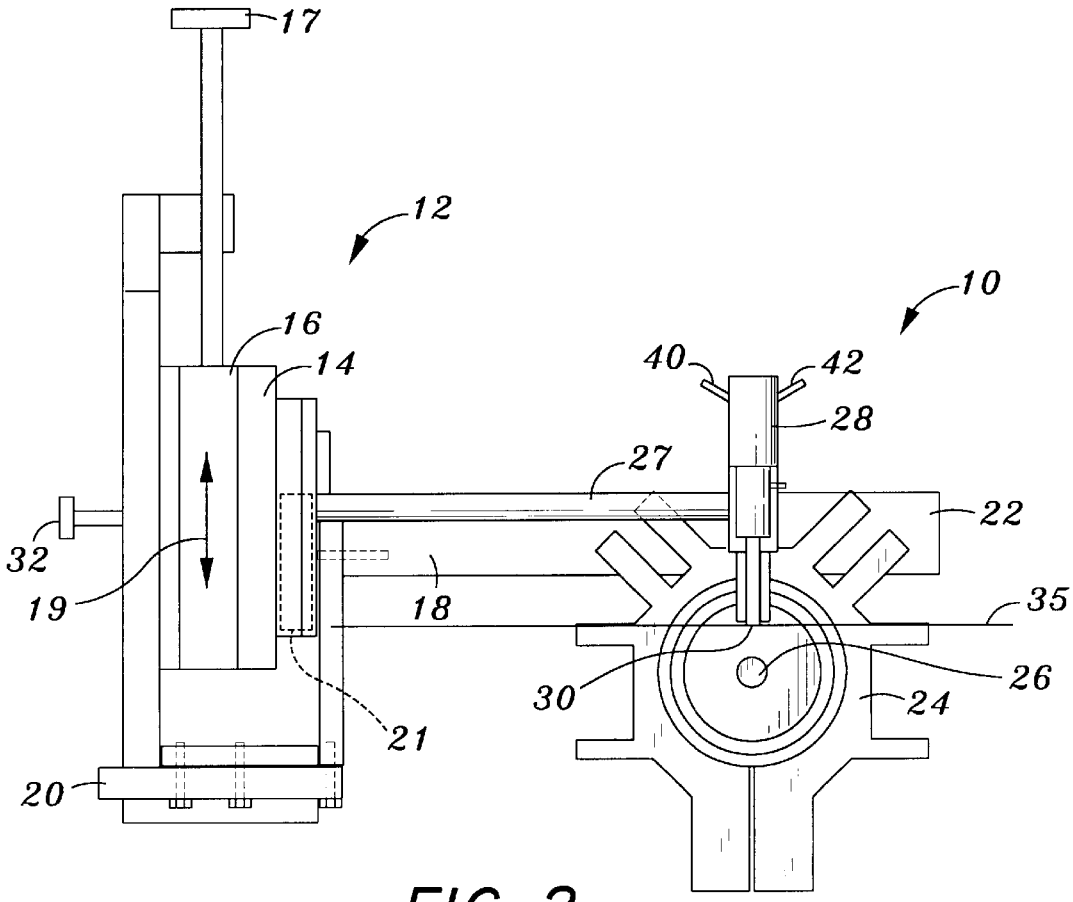
FIG. 2 is a front elevation view of the powder injector assembly of FIG. 1.
Figure 4:
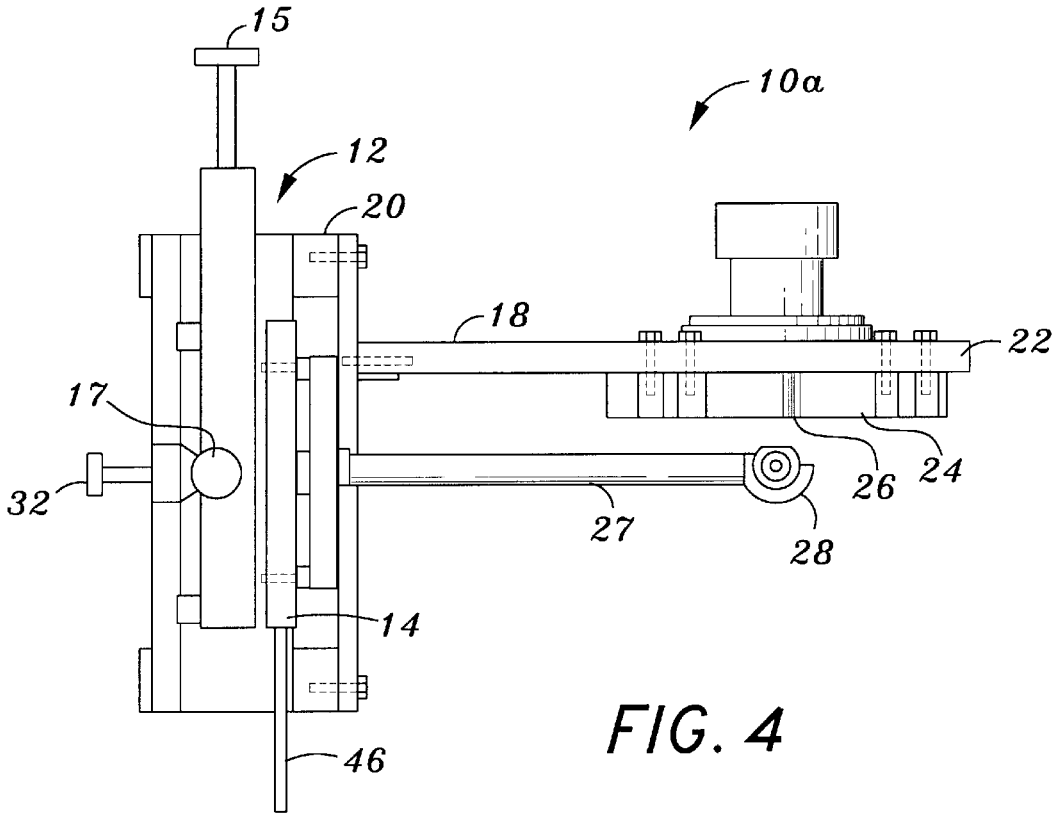
FIG. 4 is a top plan view of a powder injector assembly as in FIG. 1 except with an extension bar.

Referring to FIGS. 1 and 2, a powder injector assembly 10 having a stage member 12 independently movable in horizontal and vertical directions is illustrated. The stage member 12 has conventional horizontal and vertical components 14, 16, each movable by rotating respective first and second hand-operable rotatable control knobs 15, 17 that lead to respective conventional worm gear drives (not shown). As illustrated in FIGS. 1 and 2, a first support arm 18 is mounted to a stationary frame element 20 of the stage member 12 and extends generally laterally perpendicularly therefrom to retain at its distal end 22 a gas nozzle 24 such as a standard plasma gun nozzle having an exit port 26 from which heated gas flows under pressure. A powder injector 28 is connected to the distal end of a second support arm 27 extending from the horizontal component 14 and having a downwardly-extending arm 21 terminating in line with a powder injection nozzle port 30 of the injector 28 such that the centerline rotation axis of the injector coincides with the tip of the nozzle port 30. Rotation of the control knob 15 moves the horizontal component 14 of the stage member 12 to thereby ultimately axially move the injector 28 toward or away from the exit port 26 of the gun nozzle 24 and thus permit selective placement forward of gas flow emanating from the exit port 26. FIG. 4 illustrates an alternative construction of a powder injector assembly 10*a* wherein an extension bar 46 accommodates a greater distance of movement of the horizontal component 14 to thereby provide more versatility with respect to placement of the injector 28. In all other respects, the injector assembly 10*a* in FIG. 4 is identical to that of FIG. 1.

Figure 3:
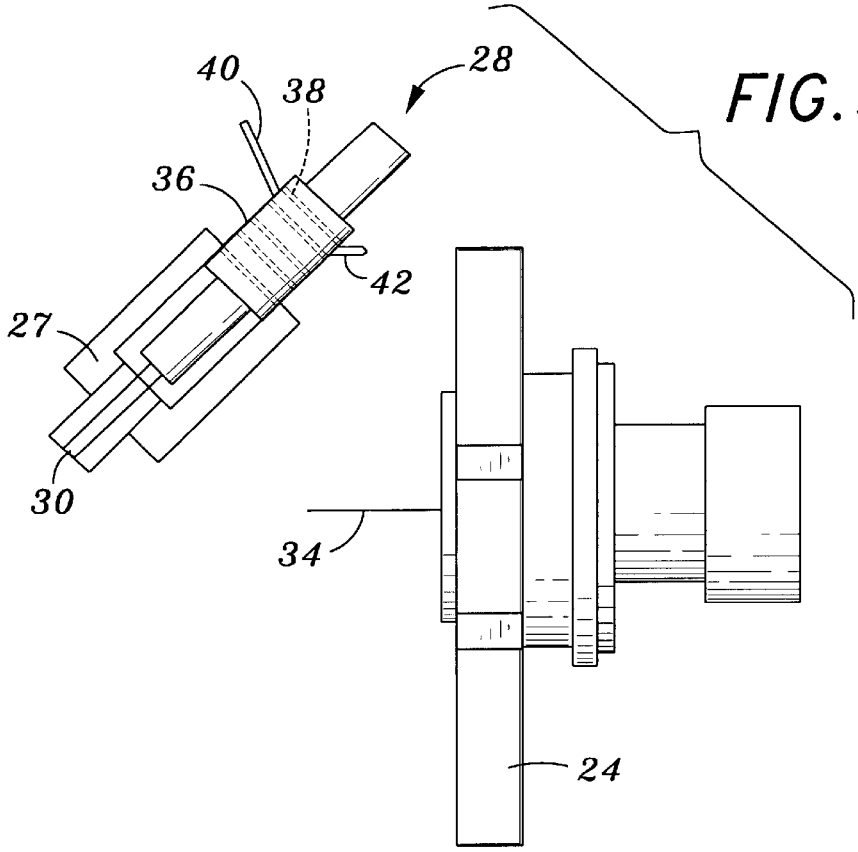
FIG. 3 is a side elevation view of a powder injector of the powder injector assembly of FIG. 1.

Vertical movement capability of the stage member 12 as shown by the double arrow 19 is accomplished by mounting the horizontal component 14 to the vertical component 16 as illustrated in FIG. 2. As is there apparent, rotation of the control knob 17 moves the vertical component 16 to accomplish movement of the second support arm 27 which ultimately translates to radial movement of the powder injector 28 in relation to a centerline of gas flow emanating from the exit port 26 to thereby permit radial selective placement of the injection nozzle port 30. Finally, angular movement of the powder injector 28 is accomplished by hand operation of a control knob 32 linked as a rotating axis 35 in line with the injection nozzle port 30 to thereby permit selective angular movement of the injector 28 while the nozzle-port point of powder injection remains automatically fixed as the axis of rotation. FIG. 3 exemplifies such angular placement, and shows the injection nozzle port 30 at an outwardly directed 45° angle in relation to the centerline 34 of gas flow.

As described earlier, powder within a powder injector is heat sensitive and is deposited on a substrate by heating said powder within a hot gas flow during deposition to thereby cause melting and liquification of the powder for final product deposition on the substrate. However, because the powder is so meltable, it must be maintained below its melting point while in the powder injector. In order to meet this temperature control requirement while also utilizing the injection nozzle placement capabilities in invasive relationship with hot gas flow as provided in the present invention, the present powder injector 28 is constructed with an integral standard cooling jacket encasement 36 as a cooling component through which a cold liquid such as water is circulated. The encasement 36 has a conventional circulation labyrinth 38 with a liquid entry line 40 from a liquid source (not shown) and a liquid exit line 42 to thereby permit a continuous fluid flow and consequent removal of heat so that powder within the powder injector is maintained in powder form. While liquid cooling is here illustrated, it is to be understood that gas cooling such as with air can be employed, with gas flow directed around the powder injector 28 in adequate volume to effectuate cooling.

In operation, heated gas is first made to flow from the exit port 26 of the gas nozzle 24 and is directed toward the surface of a substrate to be coated. Once proper gas flow direction is attained and cooling of the powder injector 28 is commenced, an operator chooses a precise powder issuance location where powder is released from the injection nozzle port 30 of the powder injector 28 into the gas flow for melting and delivery on the substrate surface. The chosen powder issuance location is reached by incrementally manipulating one or more of the control knobs 15, 17, 32 to thereby independently radially, axially, and/or angularly position the injection nozzle port 30 in relation to the axial centerline of gas flow. When such nozzle positioning is satisfied, powder particles are issued through the injection nozzle port 30 into the path of gas flow to be melted and carried to the substrate surface where coating is accomplished. Because of the powder introduction versatility so provided by the present powder injector assembly 10, coating operations are of high quality and efficiency.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A powder injector assembly for delivering heat-meltable powder into an axial flow of heated gas emanating under pressure from a gas nozzle exit port of a powder coating applicator, the injector assembly comprising:

a) a powder injector rotatable in a plane whose centerline is perpendicular to the flow of heated gas from the gas nozzle exit and which is positionable downstream from the gas nozzle exit port for issuing powder into said flow of heated gas;

b) an injection nozzle exit port integral with and leading from the injector and disposed in said centerline for angular rotation around said centerline, said injection nozzle exit port alignable with the gas nozzle exit port for issuing powder into said flow of heated gas; and c) a cooling system integral with the injector for removing heat from said injector.

2. A powder injector assembly as claimed in claim 1 wherein the injector is incrementally movable laterally for incrementally radially moving the injection nozzle in relation to said flow of heated gas.

3. A powder injector assembly as claimed in claim 2 wherein the injector is incrementally movable laterally for incrementally radially moving the injection nozzle on either side of an axial centerline of said flow of heated gas.

4. A powder injector assembly as claimed in claim 1 wherein the injector is incrementally movable axially for incrementally axially moving the injection nozzle toward and away from the gas nozzle exit port.

5. A powder injector assembly as claimed in claim 1 wherein the injector is incrementally operable angularly for incrementally angularly moving the injection nozzle from perpendicular to parallel in relation to an axial centerline of said flow of heated gas.

6. A powder injector mount for supporting a powder injector having an injection nozzle exit port and for positioning said injection nozzle port downstream from a powder coating applicator having a gas nozzle exit port from which a flow of heated gas with an axial centerline can emanate under pressure, the mount comprising a base member having a movable support arm extending therefrom, said support arm having a distal end connectible to the powder injector for placement-of the injection nozzle exit port of said connectible powder injector downstream from the gas nozzle port and in general alignment with the axial centerline of the flow of heated gas, said mount rotatable for rotating the powder injector in a plane whose centerline is perpendicular to the flow of heated gas from the gas nozzle exit port and wherein the nozzle exit port is disposed in said centerline.

7. A powder injector mount as claimed in claim 6 wherein the support arm is incrementally operable laterally for incrementally radially moving the distal end of the support member.

8. A powder injector mount as claimed in claim 6 wherein the support arm is incrementally operable axially for incrementally axially moving the distal end of the support member.

9. A powder injector mount as claimed in claim 6 wherein the support arm is incrementally operable angularly for incrementally angularly moving the distal end of the support member.

* * * * *